United States Patent [19]

Riblett

[11] Patent Number: 4,869,987

[45] Date of Patent: Sep. 26, 1989

[54] MULTIACTIVE ELECTROPHOTOGRAPHIC REUSABLE ELEMENT

[75] Inventor: Susan E. Riblett, Rochester, N.Y.

[73] Assignee: Eastman Kodak Company, Rochester, N.Y.

[21] Appl. No.: 275,464

[22] Filed: Nov. 23, 1988

[51] Int. Cl.[4] ..... G03G 5/14

[52] U.S. Cl. ..... 430/59; 430/56; 430/66; 430/67

[58] Field of Search ..... 430/56, 59, 66, 67

[56] References Cited

U.S. PATENT DOCUMENTS

| | | | |
|---|---|---|---|
| 4,232,103 | 11/1980 | Limburg et al. . | |
| 4,397,931 | 8/1983 | Limburg et al. | 430/59 |
| 4,420,547 | 12/1983 | Nishikawa | 430/67 X |
| 4,592,980 | 6/1986 | Tomida et al. | 430/56 X |
| 4,599,286 | 7/1986 | Limburg et al. | 430/59 |

FOREIGN PATENT DOCUMENTS 0123461 10/1984 European Pat. Off. .

OTHER PUBLICATIONS

Derwent Abstract of Japanese Application J5 7132-154, published Aug. 16, 1982.

Derwent Abstract of Japanese Patent Application J5 8163 954-A, published Sep. 28, 1983.

Derwent Abstract of Japanese Application J5 8163 948-A, published Sep. 28, 1983.

*Primary Examiner*—Roland E. Martin

*Attorney, Agent, or Firm*—Bernard D. Wiese

[57] ABSTRACT

An improved reusable electrophotographic element that has an electrically conductive support, a charge-generation layer containing an aggregate photoconductive charge generating material and a charge-transport layer containing a triarylamine charge-transport material also contains 1-phenylazo-2-naphthol in a layer positioned to stabilize the element against light fatigue.

3 Claims, No Drawings

MULTIACTIVE ELECTROPHOTOGRAPHIC REUSABLE ELEMENT

FIELD OF THE INVENTION

This invention relates to multiactive electrophotographic elements, i.e., elements containing a charge-generation layer and a charge-transport layer. More particularly, the invention relates to such elements which are reusable, contain an aggregate photoconductive material in the charge generation layer, a triarylamine charge-transport material in the charge-transport layer and 1-phenylazo-2-naphthol in a layer positioned to stabilize the element against light fatigue.

BACKGROUND

In electrophotography an image comprising an electrostatic field pattern, usually of non-uniform strength (also referred to as an electrostatic latent image), is formed on an insulative surface of an electrophotographic element comprising at least a photoconductive layer and an electrically conductive substrate. The electrostatic latent image is usually formed by imagewise radiation-induced dissipation of the strength of portions of an electrostatic field of uniform strength previously formed on the insulative surface. Typically, the electrostatic latent image is then developed into a toner image by contacting the latent image with an electrographic developer. If desired, the latent image can be transferred to another surface before development.

In latent image formation the imagewise radiation-induced dissipation of the initially uniform electrostatic field is brought about by the creation of electron/hole pairs, which are generated by a material (often referred to as a charge-generation or photoconductive material) in the electrophotographic element in response to exposure to the imagewise actinic radiation. Depending upon the polarity of the initially uniform electrostatic field and the types of materials included in the electrophotographic element, part of the charge that has been generated, i.e., either the holes or the electrons, migrate toward the charged insulative surface of the element in the exposed areas and thereby cause the imagewise dissipation of the initial field. What remains is a non-uniform field constituting the electrostatic latent image.

An especially useful photogeneration material is a heterogeneous or aggregate photoconductive material of the type described in Light U.S. Pat. No. 3,615,414; Kryman et al U.S. Pat. No. 3,679,406, and Contois U.S. Pat. No. 4,350,751. Such materials are well known in the art and typically comprise a co-crystalline complex (aggregate) of at least one sensitizing dye and at least one film-forming aggregating polymer which complex is visible under magnification and is randomly distributed throughout the charge-generation layer.

Electrophotographic elements also contain a material which facilitates the migration of generated charge toward the oppositely charged surface in imagewise exposed areas in order to cause imagewise field dissipation. Such material is often referred to as a charge-transport material, as described, for example, in Hung et al U.S. Pat. No. 4,666,802 and Staudenmayer et al U.S. Pat. No. 4,719,163.

One type of well-known charge-transport material comprises a triarylamine which is a chemical compound containing at least one nitrogen atom that is bonded by at least three single bonds directly to aromatic rings or ring systems. The aromatic rings or ring systems can be unsubstituted or can be further bonded to any number and any types of substituents. Such triarylamines are well known in the art of electrophotography to be very capable of accepting and transporting charges generated by a charge-generation material.

Among the various known types of electrophotographic elements are those generally referred to as multiactive elements (also sometimes called multilayer or multi-active-layer elements). Multi-active elements are so named, because they contain at least two active layers, at least one of which is capable of generating charge in response to exposure to actinic radiation and is referred to as a charge-generation layer (hereinafter referred to as a CGL), and at least one of which is capable of accepting and transporting charges generated by the charge-generation layer and is referred to as a charge-transport layer (hereinafter referred to as a CTL). Such elements typically comprise at least an electrically conductive layer, a CGL and a CTL. Either the CGL or the CTL is in electrical contact with both the electrically conductive layer and the remaining CGL or CTL. Of course, the CGL comprises at least a charge-generation material (a photoconductor); the CTL comprises at least a charge-transport material; and either or both layers may additionally comprise a film-forming polymeric binder. Typical multiactive elements are described in the aforementioned Hung et al and Staudenmayer et al U.S. Patents.

Among the known multiactive electrophotographic elements, are those which are particularly designed to be reusable and to be sensitive to imagewise exposing radiation falling within the visible region of the electromagnetic spectrum. Reusable elements are those that can be practically utilized through a plurality (preferably a large number) of cycles of uniform charging, imagewise exposing, development and/or transfer of electrostatic latent image or toner image, and erasure of remaining charge, without unacceptable changes in their performance. For example, some reusable multiactive electrophotographic elements that are designed to be sensitive to visible radiation are those in which the CGL contains an aggregate photoconductive material and the CTL contains a triarylamine charge-generation material, as described, for example, in Berwick et al U.S. Pat. No. 4,175,960.

Elements containing such components fairly adequately perform their intended functions and, in the case of the elements described in the aforementioned Berwick et al U.S. patent, have some very important advantages over other known elements. However, there is a significant drawback associated with such elements. For example, a problem can occur when the CTL has been adventitiously exposed to light comprising significant radiation of a wavelength less than about 400 nanometers, i.e., ultraviolet radiation. Such radiation forms a significant portion of the radiation emitted by typical fluorescent room lighting. The problem can occur, for example, when an electrophotographic element is incorporated in a copier apparatus and is exposed to typical room illumination during maintenance or repair of the copier's internal components. The problem, which in commonly referred to as "light fatigue" is manifested as a loss in charge acceptance in subsequent charging cycles of the electrophotographic element as the element is exercised through its normal cycles of electrophotographic operation after having been adventitiously exposed to light comprising ultraviolet radiation.

For example, in normal cycles of operation such an element might be initially uniformly charged to a potential of about −500 volts, and it might be intended that the element should then discharge, in areas of maximum exposure to normal imagewise actinic visible exposing radiation, to a potential of about −100 volts, in order to form the intended latent electrostatic image. However, if the electrophotographic element has been adventitiously exposed to light comprising ultraviolet radiation, there is a precipitous decrease in the initial potential with an accompanying loss in image quality during normal electrophotographic operation. For example, after such exposure the initial potential may drop 30 to 40 volts or even more. The electrophotographic element may gradually return to its original behavior, e.g., accept an initial charge of −500 volts, but this occurs only after repeated cycling, e.g., 1000 cycles or after standing for several hours depending upon the duration of exposure to such radiation. It is obvious therefore, that it would be advisable to avoid or minimize the light fatigue problem in multiactive elements of the type described hereinbefore.

SUMMARY OF THE INVENTION

In accordance with this invention, 1-phenylazo-2-naphthol is used to minimize or eliminate the light fatigue problem in the multiactive elements described previously herein, without significant deleterious effect upon the sensitometric characteristics of the element. This result was completely unexpected since many chemically structurally related azo compounds and available ultraviolet radiation absorbing compounds are ineffective to eliminate or minimize light fatigue in the multiactive elements described previously. This feature of the invention is illustrated in Example 2 which follows.

Thus, this invention provides an electrophotographic element that contains an electrically conductive support, a charge-generation layer containing an aggregate photoconductive material and a charge-transport layer containing a triarylamine charge transport material. The element additionally contains the improvement of a layer positioned to stabilize the element against light fatigue wherein the layer comprises 1-phenylazo-2-naphthol having the formula:

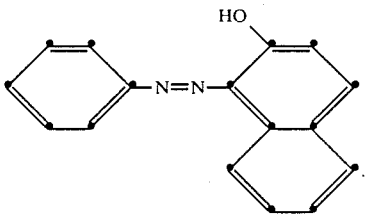

DESCRIPTION OF PREFERRED EMBODIMENTS

This invention pertains to any reusable multiactive electrophotographic element designed to be sensitive to visible radiation and containing any aggregate photoconductive charge-generating material in a CGL and any triarylamine charge-transport material in a CTL. Elements of that type and their preparation and use are well known in the art of electrophotography and therefore a detailed redescription of such elements and their preparation and use is neither necessary, nor will it be presented herein. For a detailed description of such elements and their preparation and use, see for example, Berwick et al U.S. Pat. No. 4,175,960, issued Nov. 27, 1979, and Contois U.S. Pat. No. 4,350,751, issued Sept. 21, 1982. The only difference between such well known multiactive elements and elements of the present invention is in the use of the azo compound in a layer positioned to stabilize such element against light fatigue.

Although a detailed description of the known features of the aforementioned multiactive elements is not believed to be necessary, a general description and some examples of embodiments at this point may aid in understanding the invention.

The aggregate photoconductive charge generating material employed in the practice of this invention can be prepared using procedures well known to those skilled in the art. Typically, a photographic sensitizing dye or mixtures of such dyes are combined with electrically insulating polymers and treated according to known procedures to form a separately identifiable multiphase heterogeneous composition. These heterogeneous compositions are charge generation or photoconductive materials or they can be used as sensitizers in electrophotographic compositions containing other photoconductors. Typically, the heterogeneous materials formed are multiphase organic solids. The aggregating polymeric material comprises an amorphous matrix or continuous phase which contains a discrete discontinuous phase as distinguished from a solution. The discontinuous phase is the aggregate species which is a co-crystalline complex comprised of at least one dye and at least one aggregating polymer. The term co-crystalline complex is used to refer to a crystalline compound which contains dye and polymer molecules co-crystallized in a single crystalline structure to form a regular array of molecules in a three-dimensional pattern. Particularly useful dyes are pyrylium dyes, including pyrylium, thiapyrylium and selenapyrylium dye salts, and mixtures thereof which are capable of forming sensitizing and photoconductive compositions. Electrically insulating film-forming polymers suitable for the formation of aggregate photoconductive charge-generating materials include polycarbonates, polythiocarbonates, polyvinyl ethers, polyesters, poly-alpha-olefins and phenolic resins. Mixtures of such polymers can also be utilized. Such aggregate photoconductive charge-generating materials, their preparation and use are described in numerous patents including for example, Light U.S. Pat. No. 3,615,414, issued Oct. 26, 1971; Seus U.S. Pat. No. 3,591,374, issued July 6, 1971; Kryman et al U.S. Pat. No. 3,679,406, issued July 25, 1972; and Gramza et al U.S. Pat. No. 3,732,180, issued May 8, 1973.

The electrophotographic elements of this invention also include CTL's containing triarylamine charge transport materials which facilitate the migration of generated charge within the electrophotographic element. Suitable triarylamines include non-polymeric triphenylamines illustrated in Klupfel et al U.S. Pat. No. 3,180,730, issued Apr. 27, 1965; polymeric triarylamines described in Fox U.S. Pat. No. 3,240,597, issued Mar. 15, 1966; triarylamines having at least one of the aryl radicals substituted by either a vinyl radical or a vinylene radical having at least one active hydrogen-containing group as described in Brantly et al U.S. Pat. No. 3,567,450, issued Mar. 2, 1971; triarylamines in which at least one of the aryl radicals is substituted by an active hydrogen-containing group as described in Brantly et al U.S. Pat. No. 3,658,520, issued Apr. 25, 1972; and tritolylamine. Berwick et al U.S. Pat. No. 4,175,960, and Contois U.S. Pat. No. 4,350,751, previously referred to herein, also contain detailed descriptions of typical CTL layers.

The electrically conducting supports employed in the practice of this invention include those well known in the prior art. Examples of such supports include paper, cermet or carbon conducting layers, aluminum-paper laminates, metal foils such as aluminum foil and zinc foil, metal plates such as aluminum, copper, zinc, brass and galvanized plates; vapor deposited metal layers such as silver, nickel, aluminum and the like, coated on paper or conventional photographic film bases such as cellulose acetate or polystyrene. An especially useful conducting support is prepared by coating a support material such as poly(ethylene terephthalate) with a conducting layer containing a semiconductor dispersed in a resin or vacuum deposited on the support. Such conducting layers are described in Trevoy U.S. Pat. No. 3,245,833, issued Apr. 12, 1966.

As previously indicated herein, the electrophotographic elements of this invention comprise a layer that contains 1-phenylazo-2-naphthol which layer is positioned to stabilize the element against light fatigue. It is normally convenient to incorporate the azo compound into the CTL or CTL's or another layer between the source of light comprising ultraviolet radiation and the CTL to be stabilized, i.e., the azo compound can be incorporated into any layer positioned to achieve the desired stabilization. For example, the azo compound can be incorporated into a layer overlying a CTL or a layer overlying a CTL and CGL. The azo compound is used in an effective concentration to achieve the desired stabilization which is normally a concentration of up to about 5 percent, often 2–3 percent, by weight, of the layer to which it is added.

It should be noted that the use of azobenzene and certain alkyl and alkoxy derivatives thereof to stabilize multiactive elements of the type described herein, against light fatigue, is described in my copending U.S. patent application Ser. No. 275,463 entitled "Multiactive Electrophotographic Element" and filed of even date herewith.

Of course, multiactive electrophotographic element of the invention can contain any of the optional additional layers and components known to be useful in reusable multiactive electrophotographic elements in general, such as for example, subbing layers, overcoat layers, barrier layers, screening layers, leveling agents, surfactants, plasticizers, sensitizers and release agents.

The following examples are presented to further illustrate this invention.

EXAMPLE 1

As previously indicated, 1-phenylazo-2-naphthol can be used to effectively eliminate or minimize light fatigue in multiactive electrophotographic elements, as described herein. To illustrate, a control element was prepared containing no 1-phenylazo-2-naphthol and a corresponding element was prepared containing 1-phenylazo-2-naphthol (available as Sudan I from Aldrich Chemical Inc, Milwaukee, Wis.). The elements were identical except for the presence or absence of 1-phenylazo-2-naphthol.

The support for each element was a conductive support comprising poly(ethylene terephthalate) film having vacuum-deposited thereon a thin conductive layer of nickel. On each support was coated a CGL over which was coated a CTL. Compositions of the CGL and the CTL were as follows:

CGL 6.5 wt% 4-(4-dimethylaminophenyl)-2,6-diphenylthiapyrylium hexafluorophosphate
1.5 wt% 4-(4-dimethylaminophenyl)-2-(4-ethoxyphenyl)-6-phenylthiapyrylium fluoroborate
40 wt% 1,1-bis(di-4-tolylaminophenyl)-cyclohexane
52 wt% bisphenol-A-polycarbonate The CGL was coated from a solvent mixture of 70 weight percent dichloromethane and 30 weight percent 1,1,2-trichloroethane and dried to a layer having a thickness of about 5 μm.

CTL 20 wt% tri-4-tolylamine
20 wt% 1,1-bis(di-4-tolylaminophenyl)-cyclohexane
2.5 wt% 1-phenylazo-2-naphthol
50 wt% polyester of 4,4'-(2-nobornylidene)diphenol with 60/40 molar ratio of terephthalate/azelaic acids The CTL was coated from a solvent mixture of 70 weight percent dichloromethane and 30 weight percent methyl acetate and dried to a layer having a thickness of about 12 μm.

To illustrate the light fatigue effect each element was dark adapted by being held in the dark for approximately 2 hours and then charged to a negative potential of −500 V using a conventional corona charger. The voltages were recorded for several seconds after charging and the value after 5 seconds was chosen as the initial voltage, $V_0$.

The elements were then exposed through the CTL to a fluorescent source having typically significant amounts of ultraviolet radiation output so that the intensity at the surface of the elements was 200 foot-candles. This effectively simulates adventitious exposure to light comprising significant ultraviolet radiation. Following this exposure, the elements were recharged using the same charger used to initially charge the elements to −500 volts. The voltages were read at 5 seconds and reported in the following table as $\Delta V_0$ which indicates loss of initial charge due to the exposure.

The voltages reported are averages of 15 samples. A $\Delta V_0$ of up to −50 volts is acceptable and would not result in serious loss in image quality in the element.

TABLE I

| Azo Compound | $\Delta V_0$ |
|---|---|
| None (Control) | −76.1 |
| 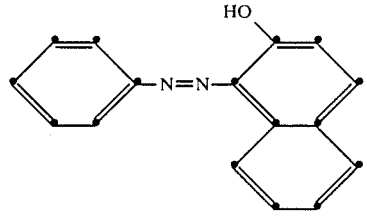 1-phenylazo-2-naphthol | −48 |

As is obvious from the $\Delta V_0$ values reported in the above Table, the 1-phenylazo-2-naphthol is effective in dealing with the problem of light fatigue experienced by the multiactive elements described herein. The improvement achieved when this compound is used in the CTL, as reported in the above Table, is also observed it is used in other layers of the element, for example, in an overcoat layer that overlies the CTL.

EXAMPLE 2

The results achieved with the 1-phenylazo-2-naphthol employed in the practice of this invention is clearly unexpected since chemically structurally related substituted 1-phenylazo-2-naphthols (Comparisons 1–3) and many known compounds reported to protect polymers against discoloration on exposure to sunlight (Comparisons 4–9), which contains substantial ultraviolet radiation, are not effective in the practice of this invention. To illustrate this feature of the invention, multiactive elements were prepared and tested as described in Example 1, except that the 1-phenylazo-2 -naphthol of Example 1 was replaced with addenda having the structures set forth in the following Table. The addenda were added in the maximum concentrations that were soluble in their respective coating compositions in order to provide a meaningful comparison.

TABLE II

| Comparison | Addenda | $\Delta V_0$ |
|---|---|---|
| Control | None | −76.1 |
| 1 | 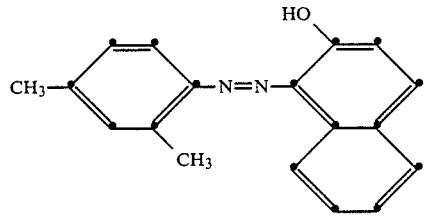 | −63.0 |
| 2 | 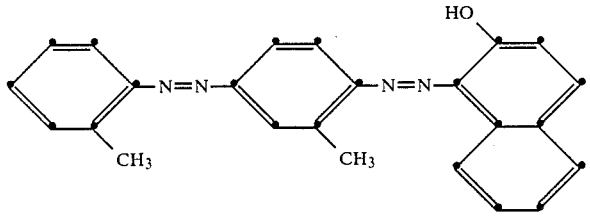 | −83.0 |
| 3 | 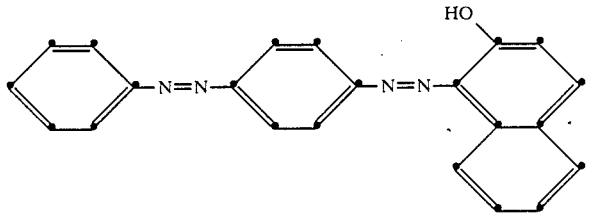 | −61.0 |
| 4 | 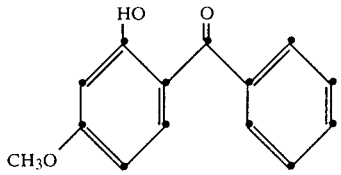 | −157.0 |
| 5 | 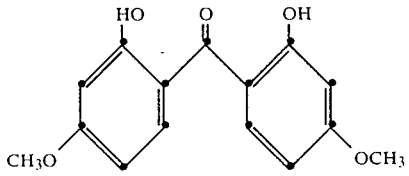 | −180.0 |
| 6 | 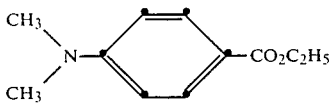 | −102.0 |

TABLE II-continued

| Comparison | Addenda | $\Delta V_0$ |
|---|---|---|
| 7 | 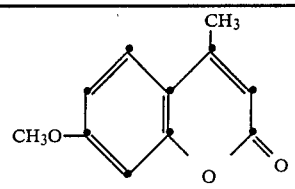 | −270.0 |
| 8 | 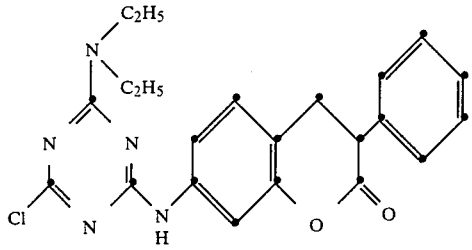 | −140.0 |
| 9 | 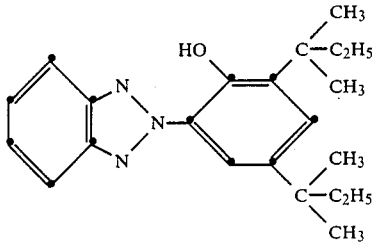 | −56.0 |

It can be seen from a comparison of the $\Delta V_0$ values reported in the above Table that many of the comparison addenda not only failed to make any significant improvement in the light fatigue but they actually made the problem much more severe.

EXAMPLE 3

The use of 1-phenylazo-2-naphthol according to this invention does not deleteriously affect the sensitometric characteristics of the multiactive elements described herein. To illustrate this feature of the invention, the multiactive element prepared according to Example 1 was tested for speed of photodecay by measuring the exposure necessary at a wavelength of 680 nm (approximately the maximum spectral sensitivity of the CGL) to discharge the element from −500 volts to −100 volts. The results are set forth in the following Table.

TABLE III

| Azo Compound | Exposure (ergs/cm$^2$) |
|---|---|
| None (Control) | 3.3 |
| 1-phenylazo-2-naphthol | 4.0 |

It is obvious from a comparison of the speed values reported in the above Table that the presence of the 1-phenylazo-2-naphthol according to this invention made no significant difference. Likewise, in regeneration tests in a typical electrophotographic copying operation, the multiactive elements of the invention exhibited speed values that were equivalent to corresponding control elements that were not subjected to light fatigue.

EXAMPLE 4

To illustrate the results obtained with 1-phenylazo-2-naphthol according to this invention in an electrophotographic copying operation, two multiactive elements was prepared according to Example 1. In one multiactive element (A) 2.5 weight percent, of 1-phenylazo-2-naphthol is added to the CTL while no azobenzene was added to the CTL in a corresponding multiactive element (B) Elements A and B are then used in a conventional electrophotographic copier (Ektaprint Copier, Model 100F, a trademark of Eastman Kodak Co.) where they are subjected to 1000 cycles of operation comprising an initial charging to −590 volts ($V_0$). After 1000 cycles of operation, one-half of the element is covered while the other half is exposed for 2 hours to 60 foot-candles from fluorescent light containing a substantial amount of ultraviolet radiation. The elements are then run through an additional 1000 cycles of operation.

For element A the initial potential $V_0$ is −590 volts in the covered and uncovered areas. In contrast, in element B, the $V_0$ will drop from −590 volts to −560 volts in the uncovered area, although will recover to the original −590 volts after the additional 1000 cycles of operation.

The invention has been described in detail with particular reference to preferred embodiments thereof, but it should be appreciated that variations and modifications can be effected within the spirit and scope of the invention.

What is claimed is:

1. In an electrophotographic element that is subject to light fatigue and contains an electrically conductive support, a charge-generation layer containing an aggregate photoconductive charge generating material and a charge-transport layer containing a triarylamine charge-transport material, the improvement wherein said element comprises an effective concentration of 1-phenylazo-2-naphthol in a layer positioned to stabilize said element against the light fatigue.

2. The element of claim 1, wherein the 1-phenylazo-2-naphthol is in the charge-transport layer.

3. The element of claim 1, wherein the 1-phenylazo-2-naphthol is in a layer overlying the charge-transport layer.

* * * * *